US005909142A

United States Patent [19]

Kawasaki et al.

[11] Patent Number: 5,909,142

[45] **Date of Patent: *Jun. 1, 1999**

[54] SEMICONDUCTOR INTEGRATED CIRCUIT DEVICE HAVING BURN-IN TEST CAPABILITY AND METHOD FOR USING THE SAME

[75] Inventors: Kenichi Kawasaki; Junji Ogawa, both of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/906,143

[22] Filed: Aug. 5, 1997

Related U.S. Application Data

[63] Continuation of application No. 08/393,678, Feb. 24, 1995, abandoned.

[30] Foreign Application Priority Data

Mar. 18, 1994 [JP] Japan ..... 6-049498

[51] Int. Cl.[6] ..... G05F 1/10

[52] U.S. Cl. ..... 327/543; 327/530; 327/525; 327/540; 327/541

[58] Field of Search ..... 327/538, 525, 327/540, 541, 306, 543, 530; 326/52

[56] References Cited

U.S. PATENT DOCUMENTS

| | | | |
|---|---|---|---|
| 4,157,480 | 6/1979 | Edwards | 326/52 |
| 4,158,147 | 6/1979 | Edwards | 326/52 |
| 5,028,821 | 7/1991 | Kaplinsky | 326/52 |
| 5,300,824 | 4/1994 | Iyenger | 327/540 |
| 5,309,399 | 5/1994 | Murotani | 365/189.09 |
| 5,334,888 | 8/1994 | Bodas | 326/52 |
| 5,337,272 | 8/1994 | Suwa et al. | 365/149 |
| 5,347,170 | 9/1994 | Hayakawa et al. | 327/541 |
| 5,349,290 | 9/1994 | Yamada | 324/158.1 |
| 5,396,113 | 3/1995 | Park et al. | 327/543 |
| 5,426,616 | 6/1995 | Kajigaya et al. | 365/226 |
| 5,428,299 | 6/1995 | Koshikawa | 324/763 |

*Primary Examiner*—Timothy P. Callahan
*Assistant Examiner*—Jung Ho Kim
*Attorney, Agent, or Firm*—Armstrong, Westerman, Hattori, McLeland & Naughton

[57] ABSTRACT

A semiconductor integrated circuit device includes a flat-range voltage supply unit which steps down an external power supply voltage and generates a resultant, flat-range voltage, and a burn-in voltage supply unit which generates a burn-in voltage depending on the external power supply voltage. A switching unit selects either the flat-range voltage or the burn-in voltage, a selected voltage being supplied to an internal circuit. A switching instruction unit includes switches and generates a switching instruction signal by an ON/OFF control of the switches. A switching control unit controls the switching unit in accordance with the switching instruction signal.

39 Claims, 17 Drawing Sheets

SEMICONDUCTOR INTEGRATED CIRCUIT DEVICE HAVING BURN-IN TEST CAPABILITY AND METHOD FOR USING THE SAME

This application is a continuation of application Ser. No. 08/393,678 filed Feb. 24, 1995, now abandoned.

BACKGROUND OF THE INVENTION

1. Background of the Invention

The present invention generally relates to semiconductor integrated circuit devices and methods for testing the devices. More particularly, the present invention is concerned with a semiconductor integrated circuit device having a flat-type on-chip step-down power supply circuit, and a method for performing a burn-in (acceleration) test in which an external power supply voltage exceeding the normal operation range is applied to the device in order to detect initial faults in the device.

A recent requirement of increasing the integration density of semiconductor integrated circuit devices need more miniaturized MOS transistors formed in the device. The miniaturized MOS transistors may encounter a problem about reliability. More particularly, the miniaturized MOS transistors have an increased electric field between the source and drain, which causes a hot carrier functioning to prevent the transistors from performing the transistor operation.

Recently, there has been proposed a semiconductor integrated circuit device equipped with an on-chip step-down power supply circuit in order to ensure resistivity to the hot carrier. The on-chip step-down power supply circuit receives an external power supply voltage and steps it down to thereby generate a reduced power supply voltage.

Though various on-chip step-down power supply circuits are known, they can be grouped into the following two types:

(1) a flat-type circuit capable of maintaining the step-down voltage at an approximately constant level even if the external power supply voltage varies; and (2) a circuit generating the step-down voltage varying based on a variation in the external power supply voltage.

As compared with the latter type, the step-down power supply circuit of the flat type is widely employed because the step-down voltage internally generated is maintained at an approximately constant level irrespective of a variation in the external power supply voltage and contributes to stability of the performance.

However, a problem will occur when a burn-in test (voltage accelerating test) is carried out for semiconductor devices equipped with the flat-type step-down circuit. In the burn-in test, a voltage exceeding the normal operation voltage range for internal circuits on the chip is applied to the device for a predetermined time. The normal transistors forming the internal circuits are not affected by such a high voltage. Defective transistors are rapidly degraded. After the application of the high voltage, it is determined whether there are such defective transistors. The devices having defective transistors are discarded. When the high-voltage for the burn-in test is applied to the semiconductor device equipped with the flat-type step-down power supply circuit, the circuit does not produce the step-down voltage higher than the normal operation voltage. Hence, the burn-in test cannot be carried out for semiconductor devices equipped with the flat-type step-down power supply circuits. Hence, it is desired that the above problem be overcome.

2. Description of the Related Art

FIG. 1 is a circuit diagram of an on-chip step-down power supply circuit related to the present invention. A regulator unit 14 receives an input voltage $V_D$ and supplies a regulated power supply voltage to an internal circuit (not shown for the sake of simplicity). A flat-range voltage supply unit 11 includes a resistor R0, N-channel MOS transistors Q1 through Q4 connected in the diode formation, P-channel MOS transistors Q5 and Q6 used to form a current-mirror circuit, N-channel MOS transistors Q7 through Q9, and a P-channel MOS transistor Q10.

The resistor R0 and the transistors Q1 through Q4 form a series circuit provided between a Vcc (an external power supply voltage) line 22 and ground. A connection node at which the resistor R0 and the drain and gate of the transistor Q1 are connected together is connected to a terminal 23, and the gates of the transistors Q7 and Q9.

The drains of the transistors Q5 and Q6 are respectively connected to the trains of the transistors Q7 and Q8. The sources of the transistors Q7 and Q8 are commonly connected to the drain of the transistor Q9. The gate of the transistor Q10 is commonly connected to the drains of the transistors Q5 and Q7. The drain of the transistor Q10 is connected to the gate of the transistor Q8.

A burn-in voltage supply unit 12 is made up of a P-channel MOS transistor Q11 for use in switching, P-channel MOS transistors Q12, Q13 and Q14, resistors R1 and R2, and N-channel MOS transistors Q15, Q16 and Q17. The sources of the transistors Q12, Q13 and Q14 are connected to the Vcc line 22. The gate of the transistor Q15 is connected to the drain of the transistor Q12 and the source of the transistor Q11. The drain of the transistor Q15 is connected to the drain and gate of the transistor Q13. The drain of the transistor Q16 is connected to the gate of the transistor Q12 and the drain of the transistor Q14. The gate of the transistor Q16 is connected to the connection node where the resistors R1 and R2 are connected together. The drain of the transistor Q17 is connected to the sources of the transistors Q15 and Q16.

The transistors Q13 and Q14 form a current-mirror circuit. The transistor Q17 forms a constant-current source in which an output reference voltage $V_{REF}$ obtained at the terminal 23 is applied to the gate thereof via a terminal 24. The resistors R1 and R2 form a voltage divider.

A flat-range voltage releasing signal generating unit 13 is made up of resistors R3 and R4, P-channel MOS transistors Q18, Q19 and Q23, and N-channel MOS transistors Q20, Q21, Q22 and Q24. The resistors R3 and R4 form a voltage divider which divides the external power supply voltage Vcc. The sources of the transistors Q18, Q19 and Q23 are connected to the Vcc line 22. The sources of the transistors Q20 and Q21 are connected together. The drain of the transistor Q22 is connected to the sources of the transistors Q20 and Q21. The gate of the transistor Q24 is connected to the gates of the transistors Q20 and Q22 and a terminal 25. The transistors Q18 and Q19 connected to the drains of the transistors Q20 and Q21 form a current-mirror circuit. The gate of the transistor Q21 is connected to the node at which the resistors R3 and R4 are connected together. The gate of the transistor Q23 is connected to the drains of the transistors Q18 and Q20. Further, the drains of the transistors Q23 and Q24 are connected to the gate of the transistor Q11.

A description will now be given of the operation of the circuit with reference to FIGS. 2A through 2D, which are graphs showing the relation between the internal voltage and the external power supply voltage Vcc.

When the external power supply voltage Vcc is lower than the threshold voltages of the transistors Q1 through Q4, the transistors Q1–Q4 are OFF, and the reference voltage $V_{REF}$, equal to the external power supply voltage Vcc, is output via the terminal 23. At this time, the gate potential of the transistor Q8 is balanced with the gate potential of the transistor Q7 and is equal to the external power supply voltage Vcc.

When the external power supply voltage Vcc becomes higher than a voltage Vcc1 corresponding to the threshold voltages of the transistors Q1–Q4, the transistors Q1–Q4 are turned ON, and the reference voltage $V_{REF}$ regulated at a constant level is output via the terminal 23. The constant reference voltage $V_{REF}$ is applied to the gate of the transistor Q9, which provides a constant current, and is also applied to the gate of the transistor Q7.

The current mirror circuit formed by the transistors Q5 and Q6 is formed on the drain side of the transistor Q7. Hence, the drain current equal to the drain current of the transistor Q7 flows in the transistor Q8. As a result, the gate potential of the transistor Q8 is balanced at the same potential as the gate potential $V_{REF}$ of the transistor Q7. Thus, as indicated by the solid line in FIG. 2A, the gate voltage $V_A$ of the transistor Q8 is constant (flat-range voltage) when the external power supply voltage Vcc is equal to or higher than a voltage Vcc1.

The voltage produced by dividing the external power supply voltage Vcc by means of the resistors R1 and R2 is applied to the gate of the transistor Q16. The above-mentioned reference voltage $V_{REF}$ is applied, via the terminal 24, to the gate of the transistor Q17 provided on the source side of the transistor Q16. Hence, the transistor Q17 functions as a constant-current source.

When the gate potential of the transistor Q16 is increased, the drain current thereof is increased, and the drain current of the transistor Q12 is decreased. Further, the gate potential of the transistor Q15 is increased. When the gate potential of the transistor Q15 becomes equal to the gate potential of the transistor Q16, the transistor Q12 is turned OFF. The identical currents flow in the transistors Q15 and Q16 from the current-mirror circuit of the transistors Q13 and Q14 connected to the drains of the transistors Q15 and Q16. Hence, the circuit becomes the balanced state.

Hence, as indicated by the solid line shown in FIG. 2, the gate voltage $V_B$ becomes equal to the voltage produced by dividing the voltage Vcc applied to the gate of the transistor Q16 by means of the resistors R1 and R2. Hence, the gate voltage $V_B$ is less than the external power supply voltage Vcc, and is varies in proportion to a variation in the voltage Vcc. The voltage $V_B$ is applied, as a burn-in voltage, to the source of the transistor Q11.

The output reference voltage $V_{REF}$ obtained at the terminal 23 is applied, via the terminal 25, to the gates of the transistors Q20 and Q22 in the flat-range voltage releasing signal generating circuit 13. Hence, the transistor Q22 functions as a current source. The external power supply voltage Vcc is divided by the resistors R3 and R4, and the divided voltage is applied to the gate of the transistor Q21. The voltage dividing ratio defined by the resistors R3 and R4 is set to a predetermined value greater than that defined by the resistors R1 and R2. Hence, the gate voltage of the transistor Q21 changes in accordance with a characteristic line less inclined than that shown in FIG. 2B.

The current-mirror circuit of the transistors Q18 and Q19 connected to the drains of the transistors Q20 and Q21 functions to make the drain currents of the transistors Q20 and Q21 equal to each other. When the gate voltage of the transistor Q21 is lower than the reference voltage $V_{REF}$ applied to the gate of the transistor Q20, the current flowing in the transistor Q18 becomes equal to the current flowing in the transistor Q19.

At this time, not only the current from the transistor Q18 but also the current from the transistor Q23 flow in the transistor Q20. Thus, the transistor Q23 is ON. Hence, the voltage Vc of the node at which the drains of the transistors Q23 and Q24 are connected together becomes approximately equal to the external power supply voltage Vcc applied to the source of the transistor Q23.

When the external power supply voltage Vcc is equal to a Vcc2, and the gate voltage of the transistor Q21 obtained by dividing the voltage Vcc2 becomes equal to the gate voltage $V_{REF}$ of the transistor Q20, the currents each equal to half the drain current of the transistor Q22 flows in the transistors Q20 and Q21. Hence, the transistor Q23 is turned OFF. Hence, the above voltage Vc becomes equal to Vss (for example, the ground level), which is the source potential of the transistor Q24 which is ON.

When the external power supply voltage Vcc is equal to or higher than the voltage Vcc2, the transistor Q23 is turned OFF in the above manner, and the voltage Vc becomes low (Vss). Hence, the voltage Vc is varied as indicated by the solid line in FIG. 2C. The voltages Vcc1 and Vcc2 are respectively set to the lower and upper limits of the external power supply voltage Vcc in the normal operation of the semiconductor device.

The voltage Vc is applied to the gate of the transistor Q11, and controls the switching thereof. More particularly, when the external power supply voltage Vcc is equal to or higher than the voltage Vcc2, a flat-range voltage releasing signal at a low level is applied to the gate of the transistor Q11 whereby it is turned ON. When the voltage Vcc is lower than the voltage Vcc2, the flat-range voltage releasing signal at a high level is applied to the gate of the transistor Q11 whereby it is turned OFF.

Hence, when the external power supply voltage Vcc is lower than Vcc2, the transistor Q11 is OFF, and the flat-range voltage $V_A$ from the flat-range voltage supply unit 11 is output to the regulator unit 14. When the external power supply voltage Vcc is equal to or greater than Vcc2, the transistor Q11 is ON, and the voltage $V_A$ is less than the voltage $V_B$. As a result, the burn-in voltage $V_B$ from the burn-in voltage supply unit 12 is applied to the regulator unit 14 via the transistor Q11.

As a result, the input internal voltage $V_D$ applied to the regulator unit 14 is changed as a function of the external power supply voltage Vcc, as indicated by the solid line shown in FIG. 2D. It can be seen from FIG. 2D that there is the burn-in voltage on a straight line V passing through any value within the normal operation voltage range between Vcc1 and Vcc2 as well as the origin. Hence, in the burn-in test, it is possible to provide the regulator unit 14 with the burn-in voltage in the same ratio with respect to the external power supply voltage Vc as that in the normal operation. In FIG. 2D, the one-dot chained line VI indicates the characteristic of the voltage applied to the gate of the transistor Q21 from the node at which the resistors R3 and R4 are connected together.

As described above, switching between the burn-in voltage and the flat-range voltage is carried out on the basis of the level of the external power supply voltage Vcc. However, the releasing voltage Vcc2 at which the switching takes place fluctuates due to desperation in the production process or the ambient temperature. Hence there is a possibility that an erroneous voltage is applied to the internal circuits. For examples the burn-in voltage is output in the normal operation or the burn-in test cannot be performed.

SUMMARY OF THE INVENTION

It is a general object of the present invention to provide a semiconductor integrated circuit device and a method for testing the same in which the above disadvantages are eliminated.

A more specific object of the present invention is to provide a semiconductor integrated circuit device and a method for testing the same in which the burn-in test can be definitely carried out irrespective of whether or not there is any desperation in the production process or a variation in the ambient temperature.

The above objects of the present invention are achieved by a semiconductor integrated circuit device comprising:

- a flat-range voltage supply unit which steps down an external power supply voltage and generates a resultant, flat-range voltage;
- a burn-in voltage supply unit which generates a burn-in voltage depending on the external power supply voltage;
- a switching unit which selects either the flat-range voltage or the burn-in voltages a selected voltage being supplied to an internal circuit; and
- a switching instruction unit which includes switches and generates a switching instruction signal by an ON/OFF control of the switches; and
- a switching control unit which controls the switching unit in accordance with the switching instruction signal.

The above objects of the present invention is also achieved by a method of testing a semiconductor integrated circuit device including comprising:

- flat-range voltage supply unit which steps down an external power supply voltage and generates a resultant, flat-range voltage;
- a burn-in voltage supply unit which generates a burn-in voltage depending on the external power supply voltage;
- a switching unit which selects either the flat-range voltage or the burn-in voltage, a selected voltage being supplied to an internal circuit; and
- a switching instruction unit which includes first and second switches and generates a switching instruction signal by an ON/OFF control of the first and second switches; and
- a switching control unit which controls the switching unit in accordance with the switching instruction signal, the method comprising the steps of:
  - (a) turning ON the first and second switches so that the switching control unit controls the switching unit so as to select the external power supply voltage;
  - (b) turning OFF the first switch so that the switching control unit controls the switching unit so as to select the burn-in voltage; and
  - (c) turning OFF the second switch so that the switching control unit controls the switching unit so as to select the external power supply voltage.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
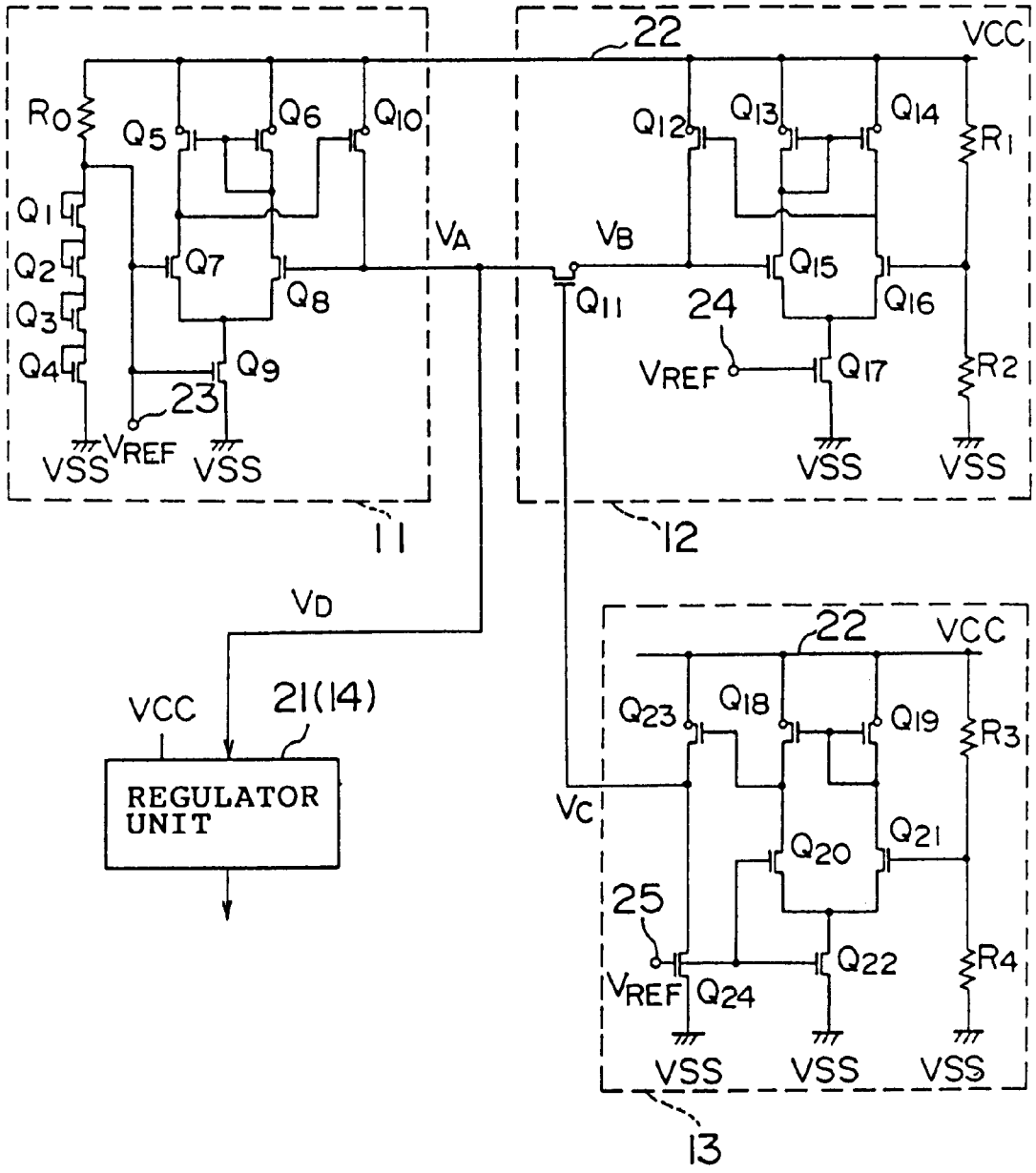
FIG. 1 RELATED ART
FIG. 1 is a circuit diagram of an on-chip flat-type step-down power supply circuit related to the present invention.
Figure 2A:
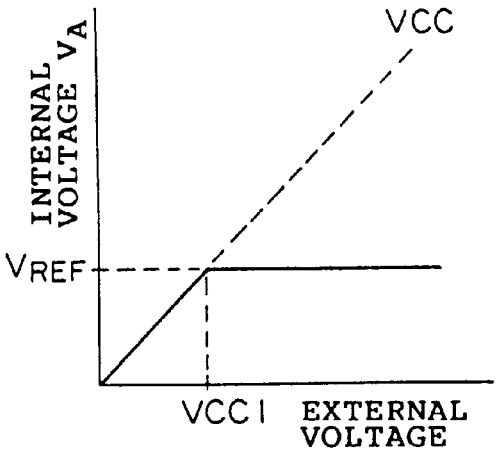
FIG. 2A RELATED ART
FIGS. 2A, 2B, 2C and 2D are graphs of the operations of the circuit shown in FIG. 1.
Figure 2C:
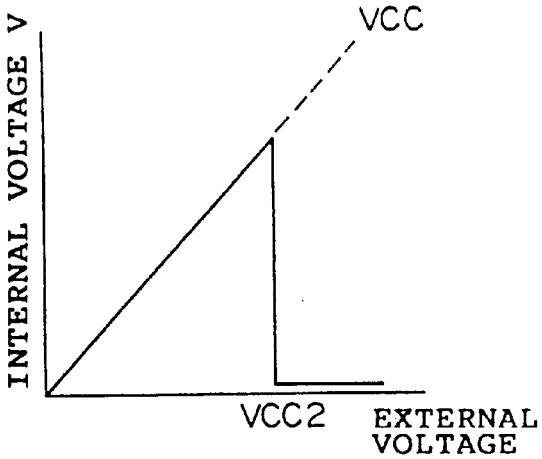
FIG. 2C RELATED ART
Figure 2B:
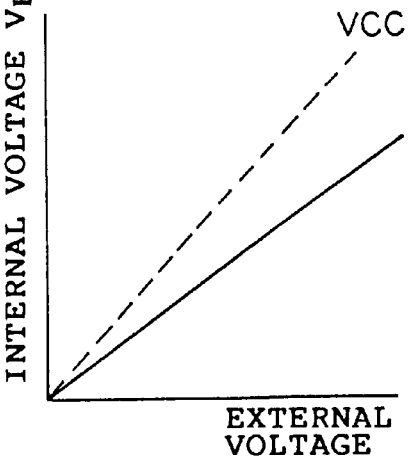
FIG. 2B RELATED ART
Figure 2D:
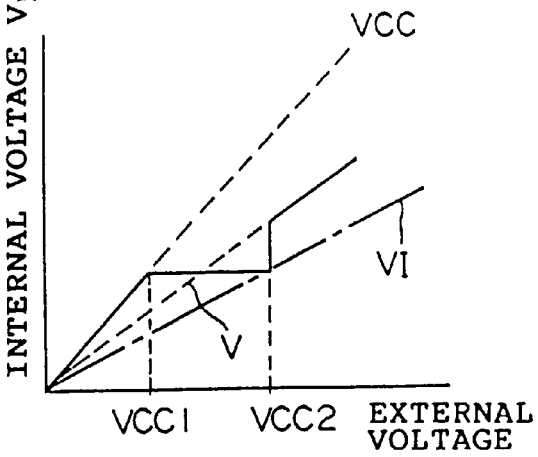
FIG. 2D RELATED ART
Figure 3:
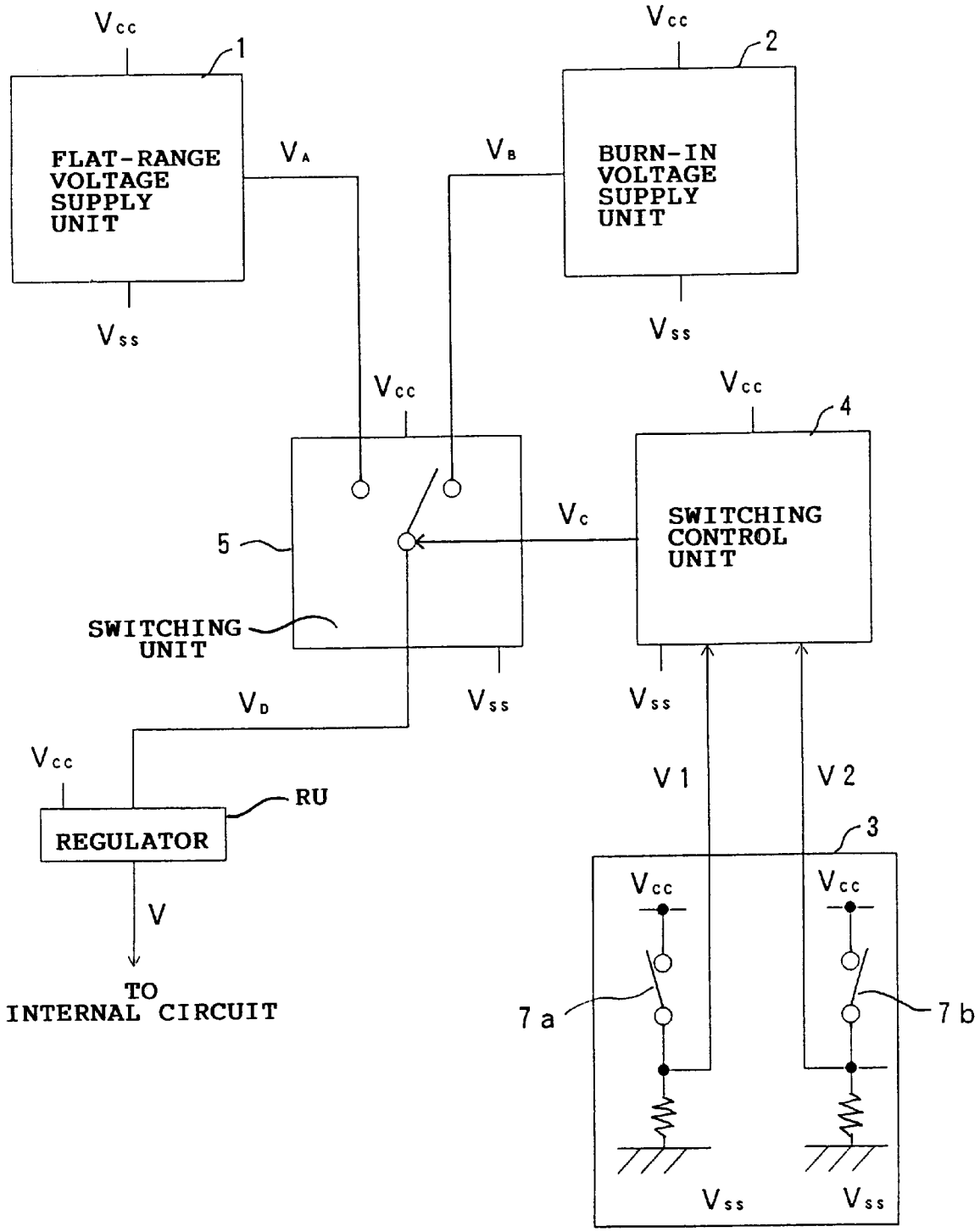
FIG. 3 is a block diagram showing the principle of the present invention.

FIG. 3 is a block diagram of the principle of the present invention. A semiconductor integrated circuit device shown in FIG. 3 includes a flat-range voltage generating unit 1, a burn-in voltage supply unit 2, a switching instruction unit 3, a switching control unit 4, and a switching unit 5. The flat-range voltage generating unit 1 steps down an external power supply voltage and supplies a resultant flat-range voltage less than the external power supply voltage. The burn-in voltage supply unit 2 generates a burn-in voltage depending on the external power supply voltage. The switching instruction unit 3 indicates a switching instruction by means of switching of a plurality of switches. The switching unit 5 selects either the flat-range voltage or the burn-in voltage under the control of the switching control unit 4.

The burn-in voltage is equal to, for example, the external power supply voltage. The burn-in voltage may be a voltage obtained by performing a level-shift operation on the external power supply voltage in a predetermined ratio. The switching instruction unit 3 includes switches 7*a* and 7*b* formed of fuses 50 and 60, which will be described later. Alternatively, the switching instruction unit 3 is formed of an erasable programmable read only memory 73, as will be described later. The switching control unit 4 is formed of, for example, an exclusive-OR circuit 45, as will be described later. The switching unit 5 can be formed by analog switch of a CMOS structure.

A method for testing a semiconductor device having the structure shown in FIG. 3 includes the following steps. A primary test is carried out in a state in which the plurality of switches in the switching instruction unit 3 are turned ON so that the switching unit 5 selects the flat-range voltage, which is applied, via a regulator unit RU, to an internal circuit (not shown) of the semiconductor device. Next, the burn-in (acceleration test) is carried out in a state in which the first switch 7*a* of the switching instruction unit 3 is turned OFF so that the burn-in voltage can be applied to the internal circuit via the regulator unit RU. Then, a final test is carried out in a state in which the second switch 7*b* is turned OFF so that the flat-range voltage can be supplied to the internal circuit via the regulator unit RU.

As described above, the selection of the burn-in voltage or the flat-range voltage can be performed by the switching of the switches 7*a* and 7*b* of the switching instruction unit 3, rather than the level of the external power supply voltage Vcc. Hence, it is possible to definitely supply the internal circuit with the desired voltage when it is desired to be applied to the internal circuit and to thus definitely perform the primary test, the burn-in test and the final test.

Figure 4:
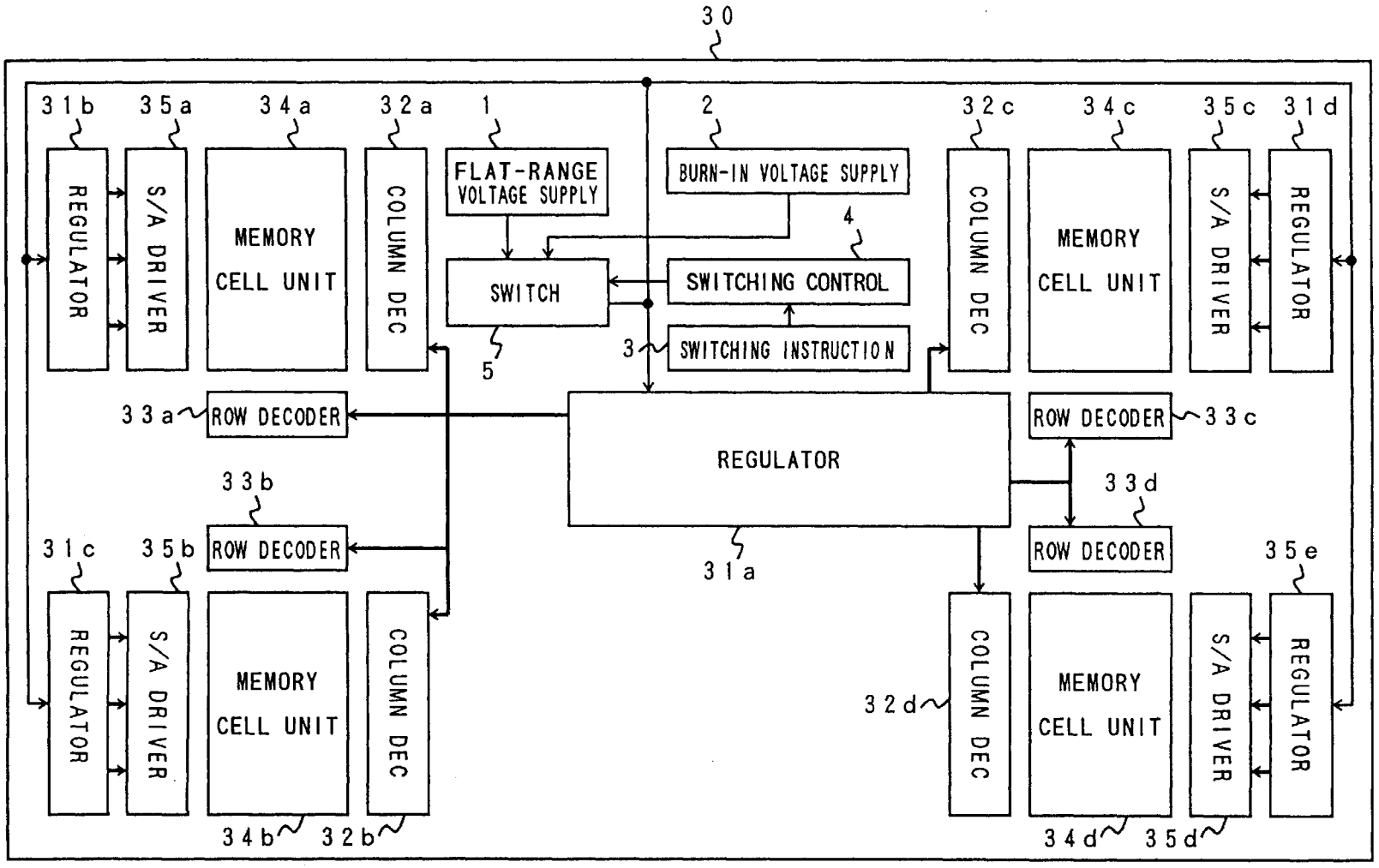
FIG. 4 is a block diagram of a semiconductor integrated circuit device according to an embodiment of the present invention.

FIG. 4 is a block diagram of the overall structure of a semiconductor integrated circuit device according to an embodiment of the present invention. In FIG. 4, parts that are the same as those shown in FIG. 3 are given the same reference numbers as previously. The flat-range voltage supply unit 1 formed on a semiconductor chip 30 steps down the external power supply voltage Vcc and generates the resultant flat-range voltage $V_A$ at a constant level. The burn-in voltage supply unit 2 generates the burn-in voltage $V_B$ which is varied in accordance with a variation in the external power supply voltage Vcc. The switching instruction unit 3 makes the switching instruction by turning ON/OFF the built-in switches. The switching control unit 4 performs the switching control of the switching unit 5 on the basis of the ON/OFF state of the switches in the switching instruction unit 3, so that either the flat-range voltage $V_A$ or the burn-in voltage $V_B$ can be selected and output to internal circuits formed on the semiconductor chip 30.

The flat-range voltage $V_A$ or the burn-in voltage $V_B$ output via the switching unit 5 is applied to regulators 31*a* through 31*b* respectively provided to internal circuits. The regulators 31*a*–31*e* supplies row decoders 33*a* through 33*d*, column decoders 32*a* through 32*d* and sense amplifier/driver circuits 35*a* through 35*d* with voltages of levels dependent on the input voltage supplied via the switching unit 5. Then, data can be written into memory cell units 34*a* through 34*d* and read therefrom.

Figure 5A:
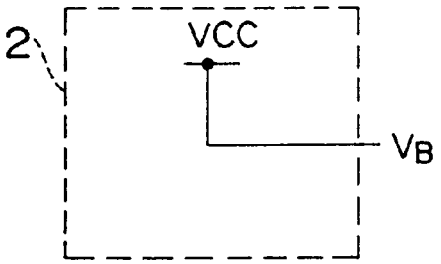
FIGS. 5A, 5B and 5C are circuit diagrams of configurations of a burn-in voltage supply unit shown in FIGS. 3 and 4.
Figure 5B:
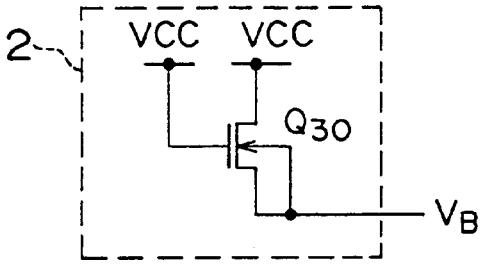
Figure 5C:
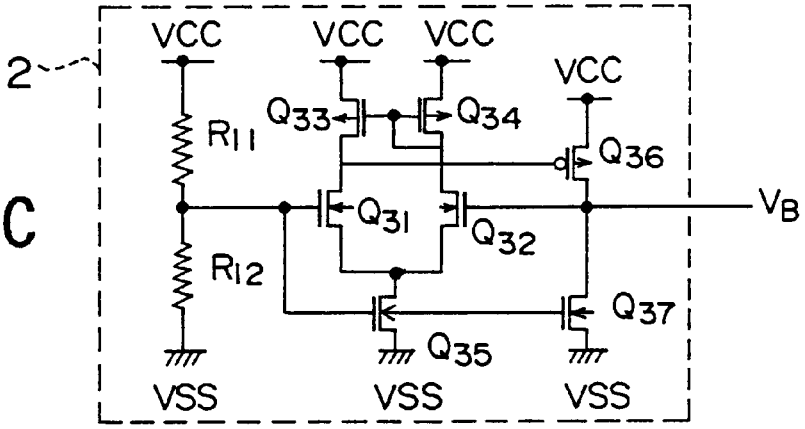
Figure 6A:
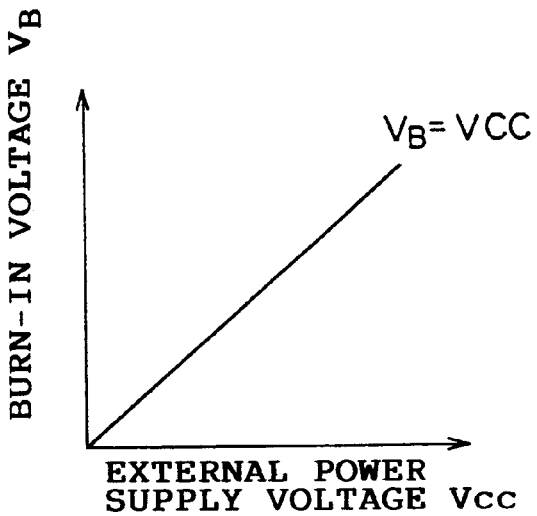
FIGS. 6A, 6B and 6C are graphs of characteristics of burn-in voltages produced by the burn-in voltage supply units shown in FIGS. 5A, 5B and 5C, respectively.

FIGS. 5A, 5B and 5C are circuit diagrams of examples of the configuration of the burn-in voltage supply unit 2. The circuit shown in FIG. 5A outputs the external power supply voltage Vcc without any modification, as the burn-in voltage $V_B$. The circuit shown in FIG. 5A has a burn-in voltage ($V_B$) vs. external power supply voltage (Vcc) characteristic shown in FIG. 6A.

Figure 6B:
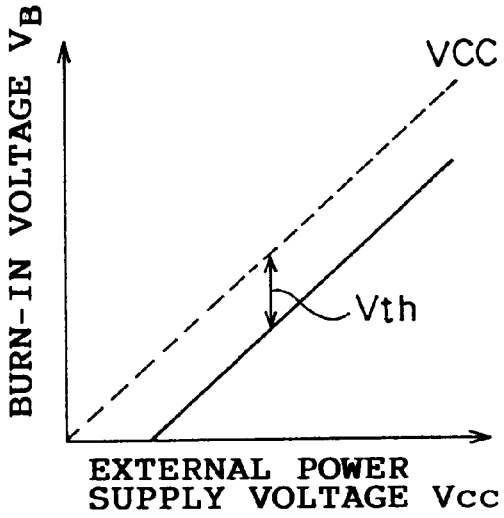

The circuit shown in FIG. 5B level-shifts the external power supply voltage Vcc by a level equal to a threshold voltage Vth of an N-channel MOS transistor Q30, and outputs a resultant level-shifted voltage as the burn-in voltage $V_B$. The circuit shown in FIG. 5B has a burn-in voltage vs. external power supply voltage characteristic shown in FIG. 6B.

Figure 6C:
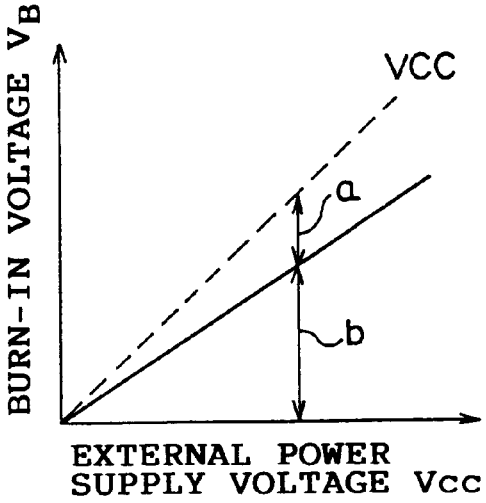

The circuit shown in FIG. 5C divides the external power supply voltage Vcc by means of resistors R11 and R12. The divided voltage is amplified by an operational amplifier made up of MOS transistors Q31 and Q32 and MOS transistors Q33, Q34 and Q35. MOS transistors Q36 and Q37 is provided for impedance transforming. The circuit shown in FIG. 5C generates the burn-in voltage $V_B$ in proportion to the ratio a:b=R11:R12 with respect to the external power supply voltage Vcc, as shown in FIG. 6C.

Figure 7:
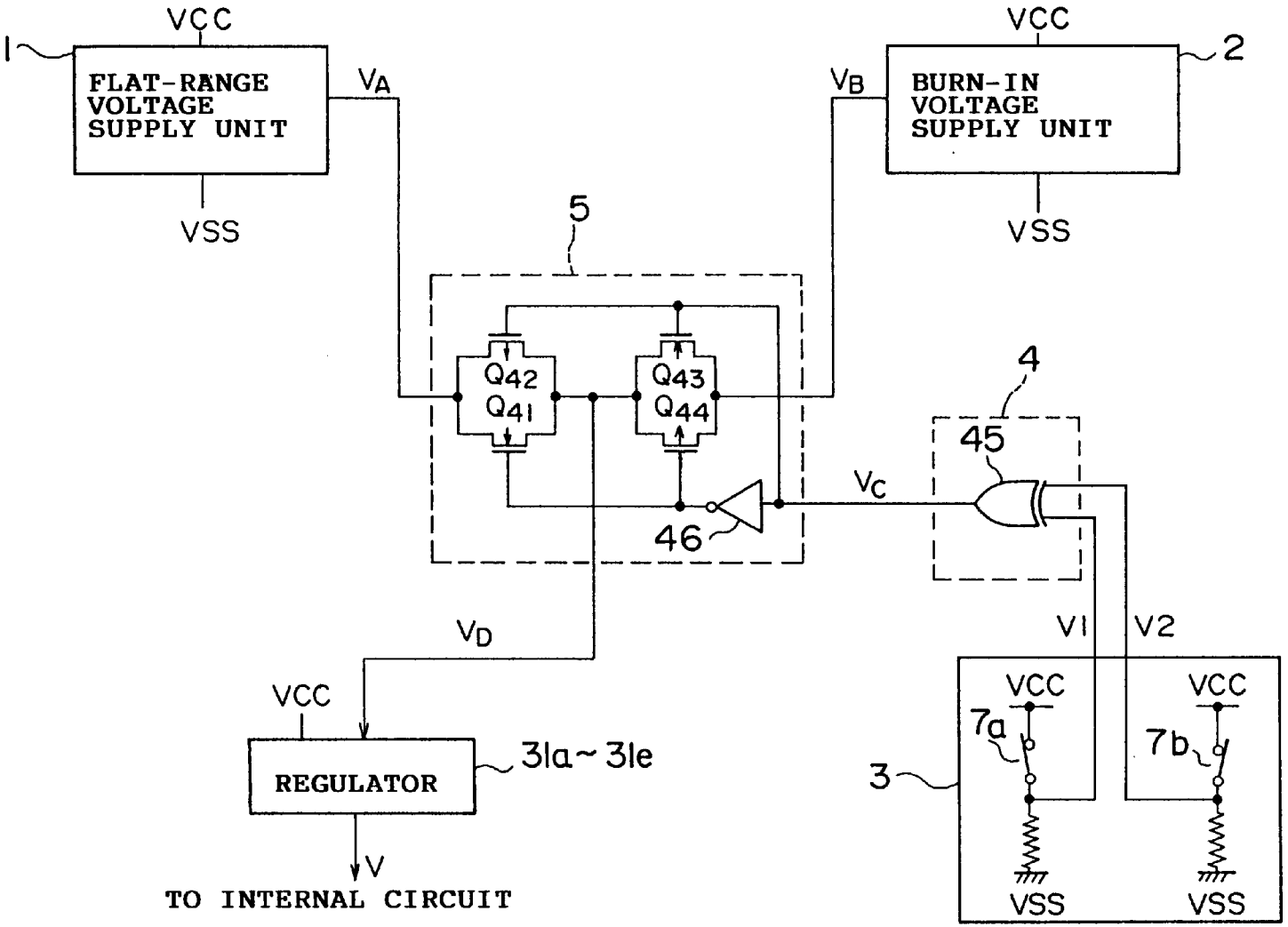
FIG. 7 is a circuit diagram of a switching instruction unit, a switching control unit and a switching unit shown in FIGS. 3 and 4.

FIG. 7 is a circuit diagram of an example of the configurations of the switching instruction unit 3, the switching control unit 4 and the switching unit 5. The switching instruction unit 3 shown in FIG. 7 includes the first switch 7*a* and the second switch 7*b*, which are supplied with the external power supply voltage Vcc. The other ends of the first and second switches 7*a* and 7*b* are grounded (Vss) via respective resistors having a high resistance value. The other ends of the first and second switches 7*a* and 7*b* may be maintained at a potential different from the ground potential. Initially, the first and second switches 7*a* and 7*b* are both ON.

Voltages V1 and V2 of the other ends of the first and second switches 7*a* and 7*b* are applied to the exclusive-OR circuit 45 forming the switching control unit 4. The exclusive-OR circuit 45 produces the low-level output signal when the first and second switches 7*a* and 7*b* are both ON and thus the voltages V1 and V2 are both high or when the first and second switches 7*a* and 7*b* are both OFF and thus the voltages V1 and V2 are both low. The exclusive-OR circuit 45 produces the high-level output signal when one of the switches 7*a* and 7*b* is ON and the other switch is OFF and thus a corresponding one of the voltages V1 and V2 is high and the other voltage is low.

The switching unit 5 is made up of an analog switch of the CMOS structure made up of an N-channel MOS transistor Q41 and a P-channel MOS transistor Q42, and another analog switch of the CMOS structure made up of an N-channel MOS transistor Q43 and a P-channel MOS transistor Q44. The flat-range voltage $V_A$ is applied to the analog switch of the transistors Q41 and Q42, and the burn-in voltage $V_B$ is applied to the analog switch of the transistors Q43 and Q44.

When the output signal of the exclusive-OR circuit 45 is low, the transistors Q41 and Q42 are turned ON, and thus the flat-range voltage $V_A$ is applied to the regulators 31*a* through 31*e*. When the output signal of the exclusive-OR circuit 45 is high, the transistors Q43 and Q44 are turned ON, and thus the burn-in voltage $V_B$ is applied to the regulators 31*a* through 31*e*. By employing the analog switches of the CMOS structure, it is possible to reduce the level shift between the flat-range voltage $V_A$ and the burn-in voltage $V_B$ in the switching unit 5 to a small level.

Figure 8:
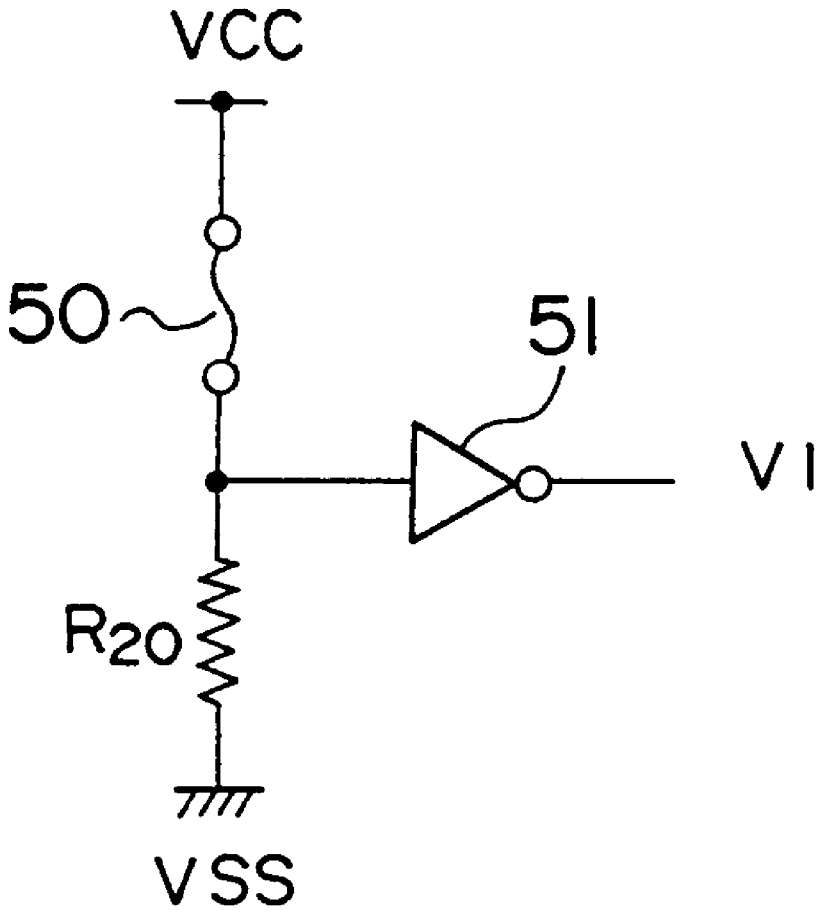
FIG. 8 is a circuit diagram of a first switch of the switching instruction unit.

FIG. 8 is a circuit diagram of the first switch 7*a*. The external power supply voltage Vcc is applied to one end of a laser fuse 50, and the other end thereof is grounded via a resistor R20 having a high resistance value. An inverter 51 is connected to the other end of the laser fuse 50, and outputs the voltage V1. In the initial state, the voltage V1 of the laser fuse 50 is low. By cutting the laser fuse 50 by a laser beam, the voltage V1 becomes high. It is possible to turn OFF the first switch 7*a* of the laser fuse 50 on the wafer.

Figure 9:
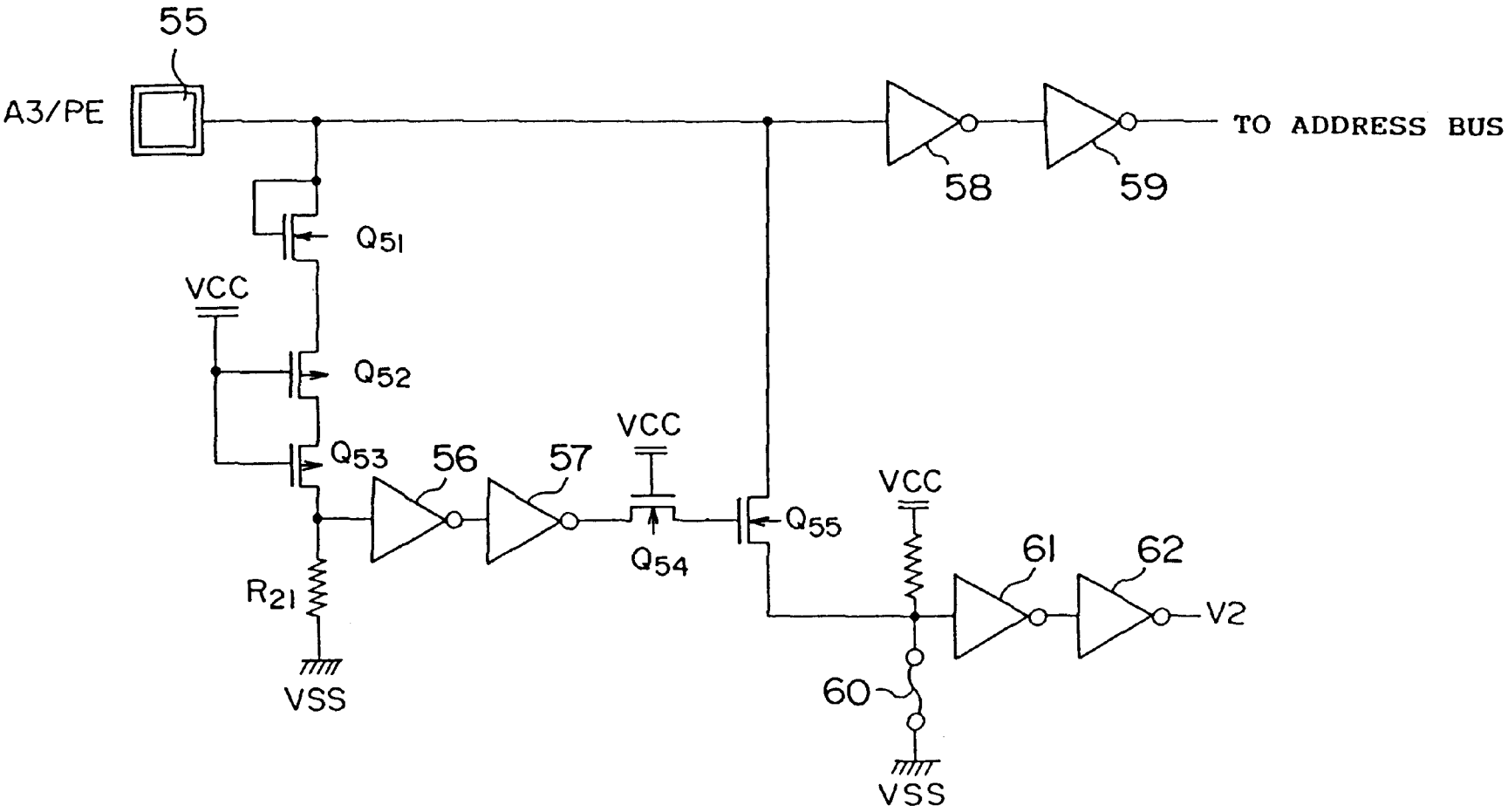
FIG. 9 is a circuit diagram of a first example of a second switch of the switching instruction unit.

FIG. 9 is a circuit diagram of the second switch 7*b*. A pin or terminal 55 shares receipt of an address signal A3 and a PE input signal. The signal PE is used to cut the fuse 60 shown in FIG. 9. If a voltage lower than or equal to the external power supply voltage Vcc, a P-channel MOS transistor Q52 is cut off, and the output terminal of an inverter 57 is switched to a low level because the input terminal of the inverter 57 is connected to the power supply system Vss via a high-resistance resistor R21. The high-level output of the inverter 57 cuts off an N-channel MOS transistor Q55 which has a high driving ability and a gate receiving the above high-level inverter output via an N-channel MOS transistor Q54. Hence, the signal (address A3) applied to the terminal 55 can be supplied to an address bus via address buffers 58 and 59. At this time, the input of an inverter 61 is low via a fuse 60, and thus the voltage V2 output by an inverter 62 is also low.

Figure 10:
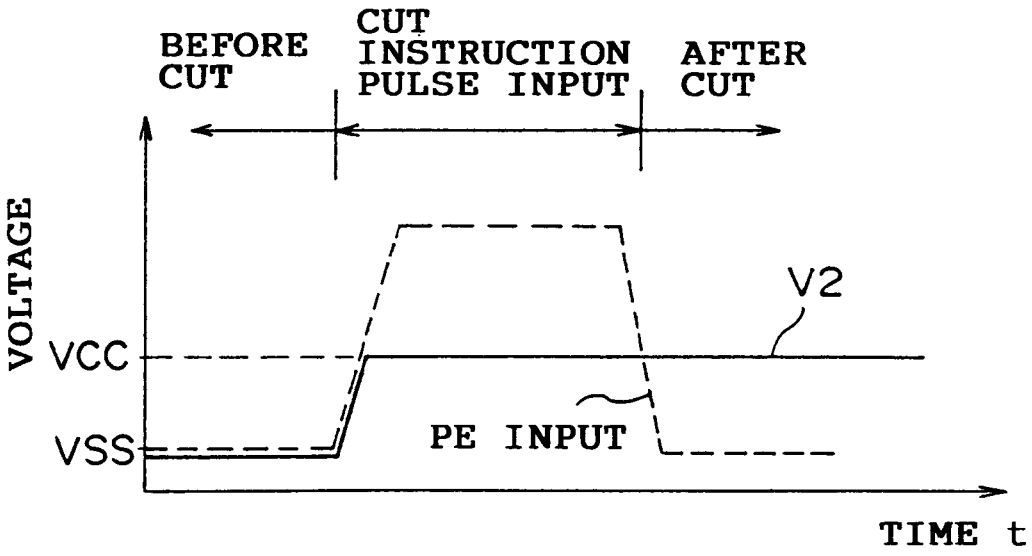
FIG. 10 is a waveform diagram showing the operation of the circuit shown in FIG. 9.
Figure 11:
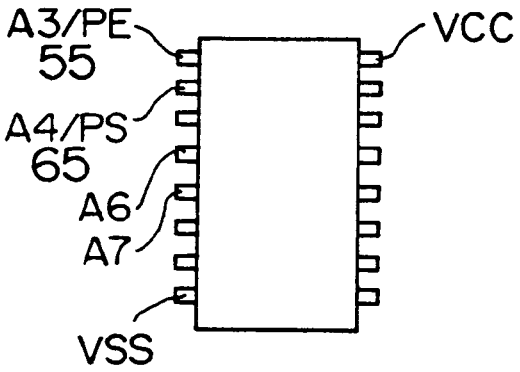
FIG. 11 is a diagram showing a pin arrangement employed when the circuit shown in FIG. 9 is used.

As shown by the broken line in FIG. 10, when a voltage sufficiently higher than the external power supply voltage Vcc is applied, as the signal PE, to the terminal 55, the gate of the P-channel MOS transistor Q52 is sufficiently higher than the source thereof via the N-channel MOS transistor Q51. Hence, the input of the inverter 56 becomes high, and the transistor Q55 is turned ON. Thus, the high voltage applied to the terminal 55 is applied to the fuse 60 made of polysilicon, so that a large current flows in the fuse 60 and is thus cut. As a result, as indicated by the solid line in FIG. 10, the voltage V2 output by the inverter 62 is switched to the high level. FIG. 11 shows an arrangement of pins (terminals) of the packaged semiconductor integrated circuit device being considered.

Figure 12:
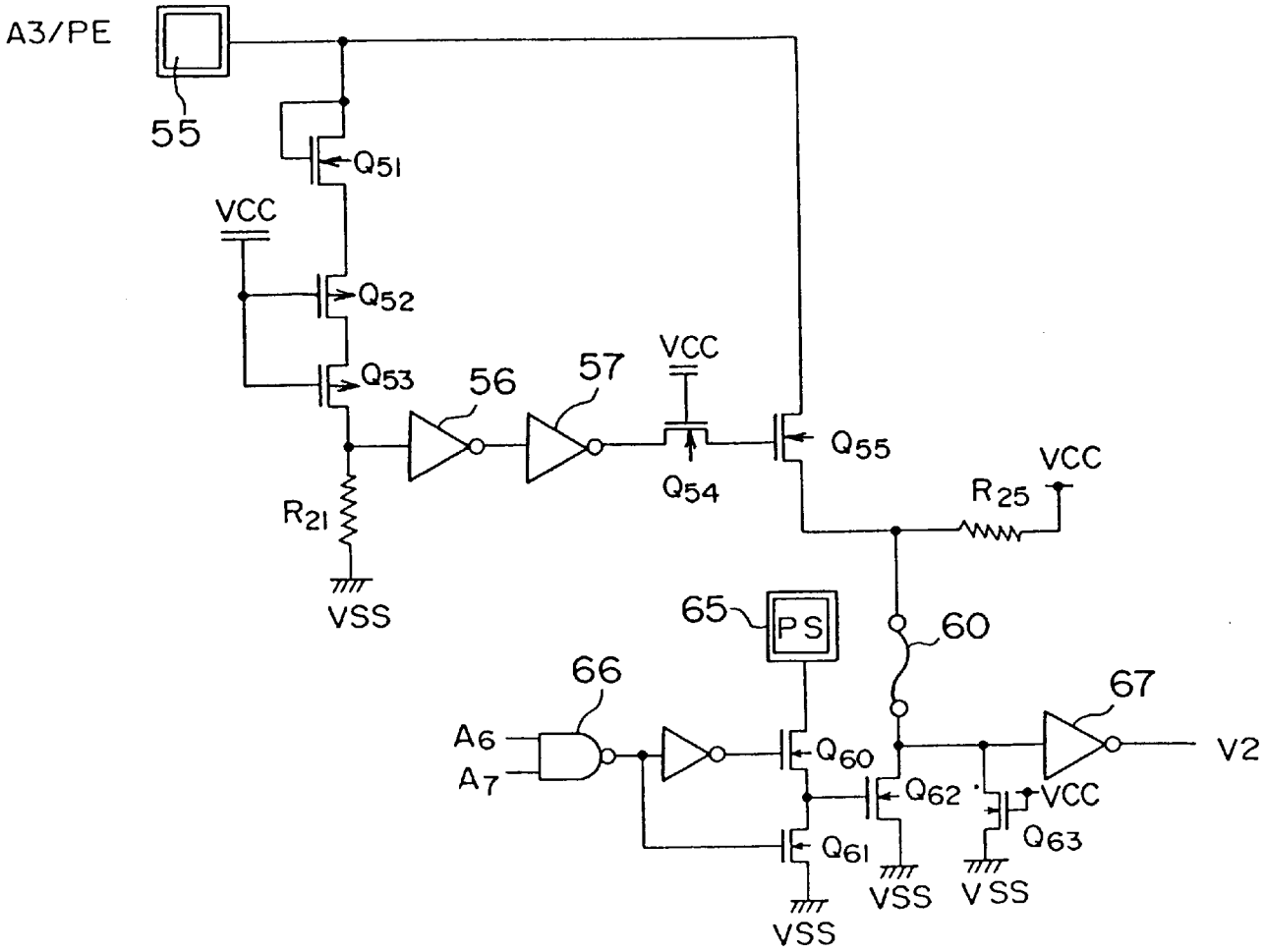
FIG. 12 is a circuit diagram of a second example of the second switch of the switching instruction unit.

FIG. 12 is a circuit diagram of another configuration of the second switch 7*b*. In FIG. 12, parts that are the same as those shown in FIG. 9 are given the same reference numbers as previously. The drain of the transistor Q55 connected to the terminal 55 is coupled to the external power supply system Vcc via a resistor R25 and one end of the fuse 10. A pin 65 shares receipt of an address signal A4 and a PS input signal used to control the current through a transistor Q62. A NAND circuit 66 is supplied with address signals A6 and Q7, and the output signal of the NAND circuit 66 is applied to the gate of an N-channel MOS transistor Q61. The inverted version of the NAND circuit 66 output by an inverter 67 is applied to an N-channel MOS transistor Q60.

The input terminal of the inverter 67 is grounded via an N-channel MOS transistor Q63 having a high resistance value. Before the fuse 60 is cut, the input terminal is supplied with the voltage Vcc via the resistor R25. Hence, the voltage V2 output by the inverter 67 is low.

Figure 13:
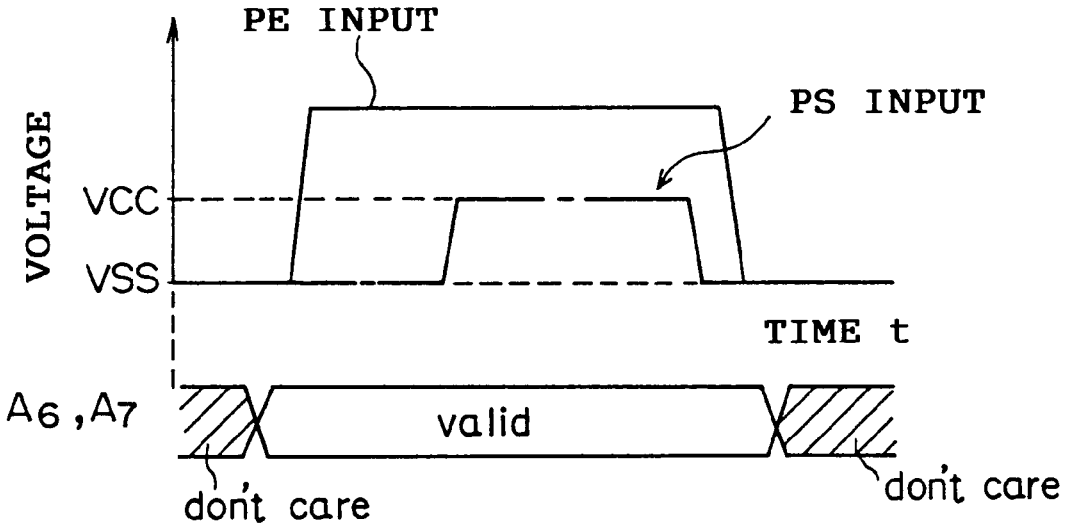
FIG. 13 is a waveform diagram showing the operation of the circuit shown in FIG. 12.
Figure 14:
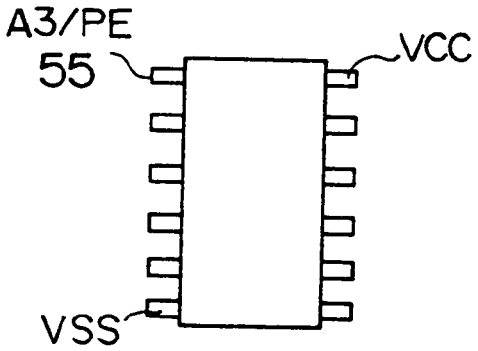
FIG. 14 is a diagram showing a pin arrangement employed when the circuit shown in FIG. 12 is used.

When a voltage sufficiently higher than the voltage Vcc is applied to the terminal 55 in the valid state obtained by switching the address signals A6 and A7 to the high level as indicated by the solid line in FIG. 13, and the high-level signal is applied to the terminal 65 as indicated by the one-dot chained line in FIG. 13, the transistors Q60 and Q61 are respectively turned ON and OFF, and N-channel MOS transistor Q62 is turned ON. Hence, a large current flows in the fuse 60, which is thus cut. As a result, the voltage V2 output by the inverter 67 is high. FIG. 14 shows an arrangement of pins (terminals) of the packaged semiconductor integrated circuit device being considered. As described above, the operation timing of the transistor Q62 directed to cutting the fuse 60 is defined by the signal PS.

Figure 15:
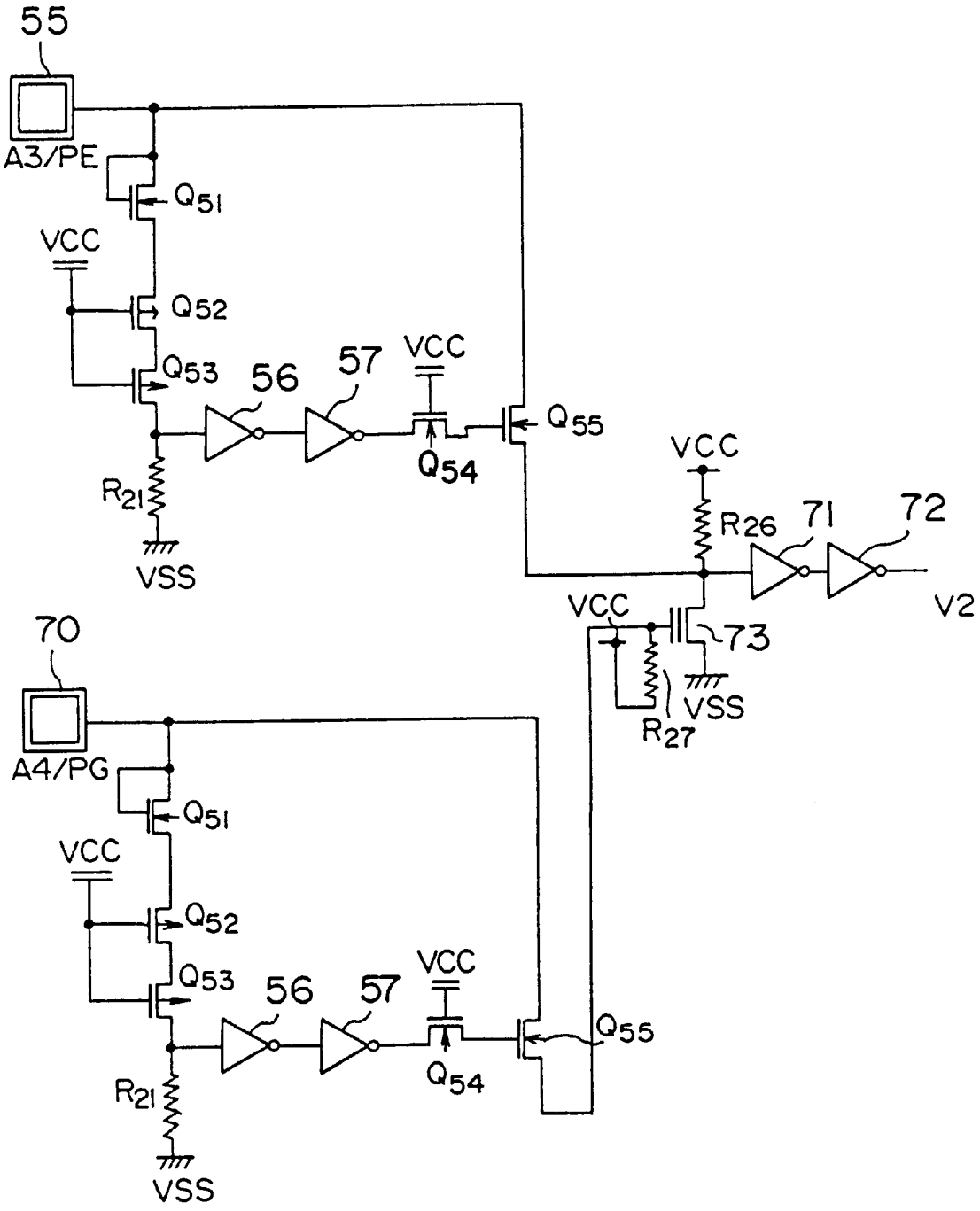
FIG. 15 is a circuit diagram of a third example of the second switching instruction unit.

FIG. 15 is a circuit diagram of yet another configuration of the second switch 7*b*. In FIG. 15, parts that are the same as those shown in FIG. 9 are given the same reference numbers as previously. The drain of the transistor Q55 connected to the terminal 55 is connected to the external power supply system Vcc via a resistor R26 having a high resistance value, and is connected to the input terminal of an inverter 71.

A terminal (pin) 70 shares receipt of the address signal A4 and a PG input signal. The drain of the transistor Q55 connected to the terminal 70 is connected to a control gate of an erasable programmable ROM (EPROM) 73, and is supplied with the external power supply voltage Vcc via a resistor R27. The signal PG is used to control the state of the EPROM 73.

The EPROM 73 is in the ON state before data is written therein because a high-level signal is applied to the control gate of the EPROM 73. In this state, the input of the inverter 71 is continuously low, and thus the output voltage V2 of an inverter 72 is low.

Figure 16:
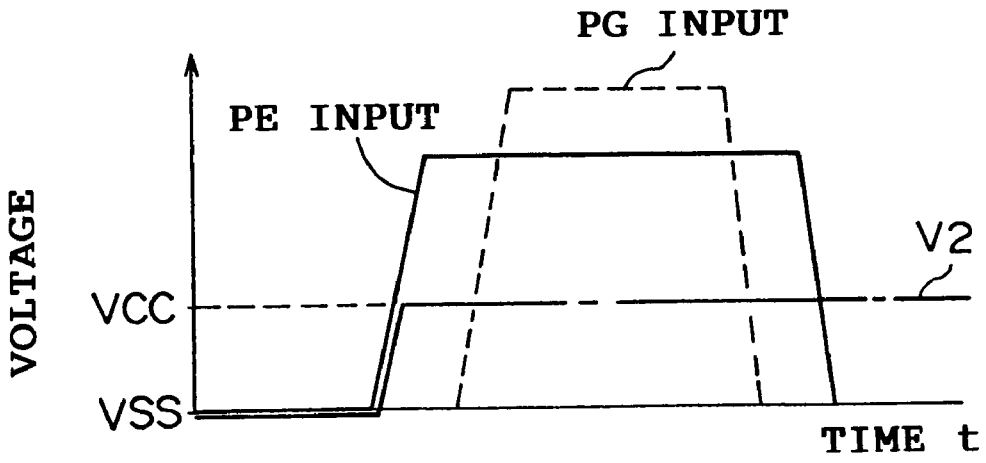
FIG. 16 is a waveform diagram showing the operation of the circuit shown in FIG. 15.
Figure 17:
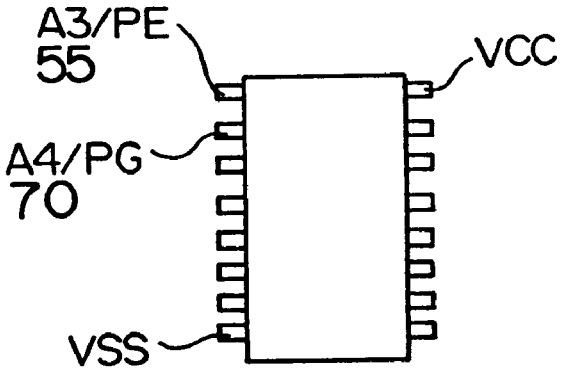
FIG. 17 is a diagram showing a pin arrangement employed when the circuit shown in FIG. 15 is used.

As shown by the solid line in FIG. 16, when a voltage sufficiently higher than the voltage Vcc is applied to the terminal 5 and a voltage sufficiently higher than the voltage Vcc is applied to the terminal 70, data can be written into the EPROM 73, and a charge is stored in the floating gate thereof. Thus, the EPROM 73 is turned OFF and the voltage V2 output by the inverter 72 is switched to the high level, as indicated by the one-dot chained line shown in FIG. 16. FIG. 17 shows an arrangement of pins (terminals) of the packaged semiconductor integrated circuit device being considered.

Figure 18A:
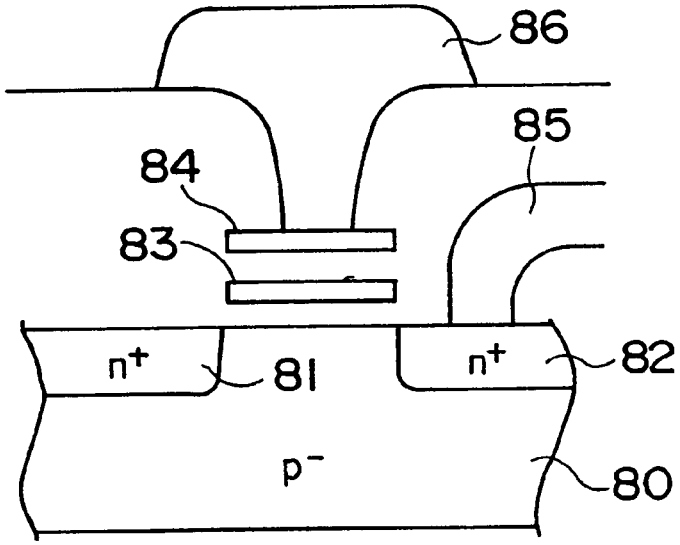
FIG. 18A is a cross-sectional view of a first structure of an EPROM used in the embodiment of the present invention.
Figure 18B:
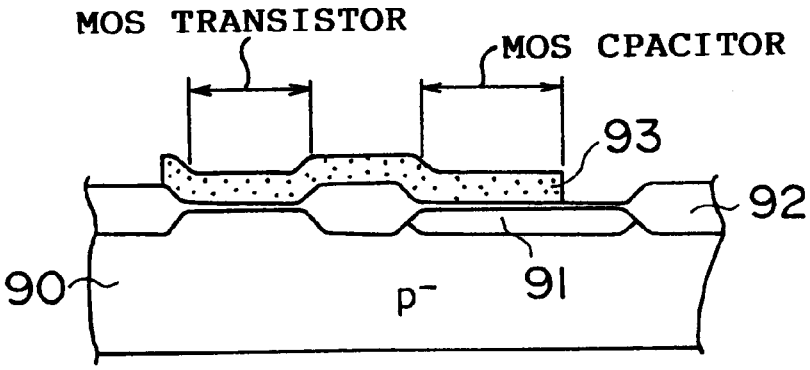
FIG. 18B is a cross-sectional view of a second structure of the EPROM used in the embodiment of the present invention.

FIGS. 18A and 18B respectively show basic structures of the EPROM 73. The EPROM having the basic structure shown in FIG. 18A is a two-layer polysilicon EPROM. As shown in FIG. 18A, $N^+$-type diffused layers 81 and 82 are formed in a $P^-$-type substrate 80. A polysilicon floating gate 83 and a polysilicon control gate 84 are formed as shown in FIG. 18A. The $N^+$-type diffused layer 82 is electrically connected to the terminal 55 via a wiring layer 85. The control gate 84 is electrically connected to the pin 70 via a wiring layer 86.

The EPROM having the basic structure shown in FIG. 18B is a single-layer polysilicon EPROM. A control gate of an $N^+$-type diffused layer 91 is formed in a $P^-$-type substrate 90. A floating gate of a polysilicon layer 93 is formed above an $SiO_2$ insulating layer 92.

Figure 19:
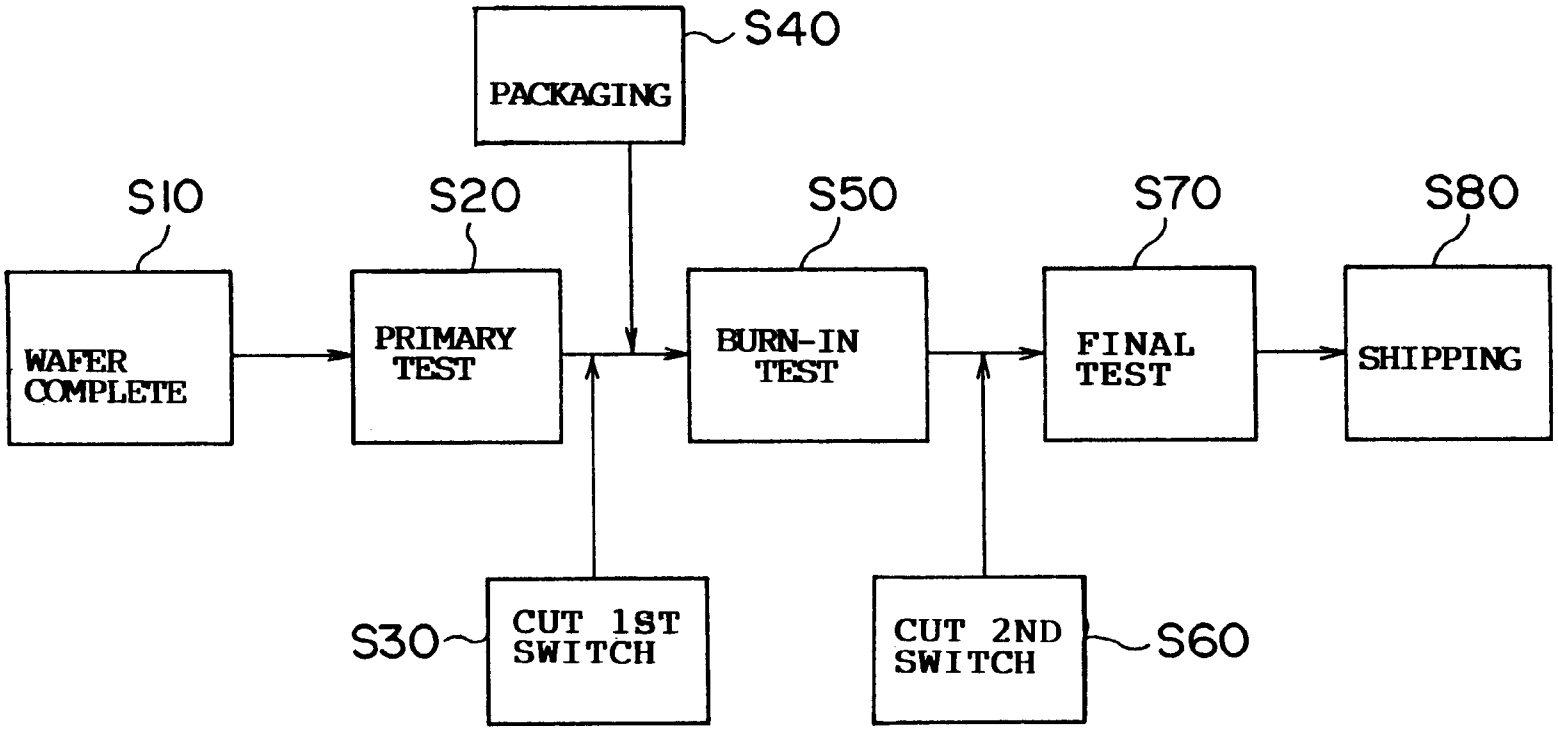
FIG. 19 is a block diagram showing a sequence of a method for testing a semiconductor integrated circuit device.
Figure 20A:
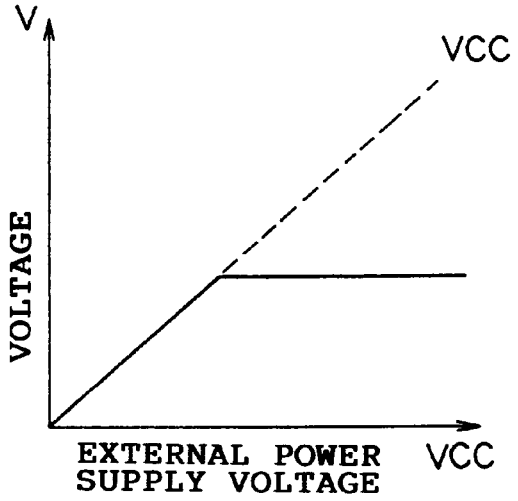
FIGS. 20A, 20B and 20C are graphs of voltage characteristics according to which voltages respectively produced in steps of the test are applied to internal circuits of the semiconductor integrated circuit device.

FIG. 19 shows a sequence of the method for testing semiconductor devices equipped with the basic structure shown in FIG. 3. In step S10, a wafer is completed. In step S20, a primary test of the wafer is performed. At this time, the first and second switches 7*a* and 7*b* of the switching instruction unit 3 in each block corresponding to a chip are in the conducting state. Hence, the voltages V1 and V2 are at the high level (or low level). Thus, the output of the exclusive-OR circuit 45 is low, and the switching unit 5 selects the flat-range voltage $V_A$ from the flat-range voltage supply unit 1. In this way, the flat-range voltage $V_A$ shown in FIG. 20A is applied to the regulators 31*a* through 31*e*. The primary test carried out in this state is intended to determine whether or not the fundamental operations of the blocks (chips) operate normally.

Figure 20B:
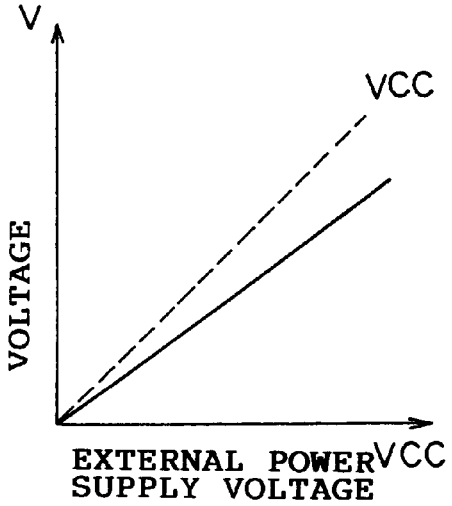

After the primary test is completed, step S30 is performed in which the first switch 7*a* is turned OFF by cutting the fuse, and the semiconductor chips cut out of the wafer are packaged so that the semiconductor devices are provided. Thereafter, the burn-in test is carried out in step S50. In the burn-in test, the outputs of the first and second switches 7*a* and 7*b* are at the different levels because the first switch 7*a* is already OFF. Hence, the output of the exclusive-OR circuit 45 is at the high level, and the switching unit 5 selects the burn-in voltage $V_B$ from the burn-in voltage supply unit 2. As a result, the voltage shown in FIG. 20B is applied to the regulators 31*a* through 31*e*, and the burn-in test for the corresponding regulators and internal circuits is carried out with a heavy load.

Figure 20C:
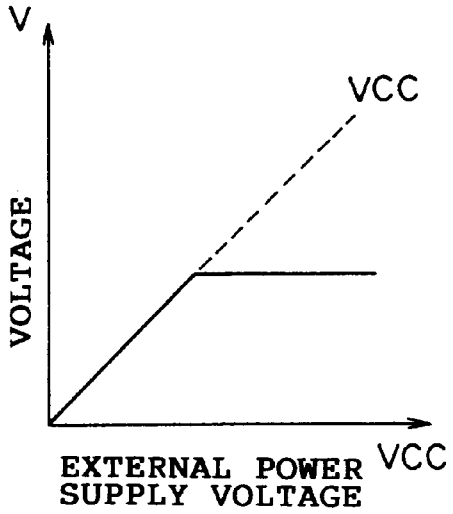

Thereafter, the second switch 7*b* is turned OFF by cutting the fuse in step S60. In this state, the final test is carried out in step S70, in which the first and second switches 7*a* and 7*b* are both OFF. The switching unit 5 selects the flat-range voltage $V_A$ from the flat-range voltage supply unit 1, and the voltage shown in FIG. 20C is applied to the regulators 31*a* through 31*e*. In this state, it is determined whether or not the predetermined characteristics (called catalog characteristics) are met. The semiconductor devices passing the final test are shipped in step S80.

The first switch 7*a* can be formed by a fuse shown in FIG. 9 or FIG. 12 or an EPROM shown in FIG. 15. However, in this alternative, the first switch 7*a* is cut after the chips are packaged in step S40.

As described above, the flat-range voltage $V_A$ is supplied to the internal circuits when the first and second switches 7*a* and 7*b* are both ON, and the burn-in voltage $V_B$ is supplied thereto when either the first switch 7*a* or the second switch 7*b* is ON. Further, the flat-range voltage $V_A$ is supplied to the internal circuits when the first and second switches 7*a* and 7*b* are both OFF. As a result, it is possible to definitely apply the flat-range voltage and the burn-in voltage to the internal circuits in the predetermined sequence, and to definitely perform the primary test, the burn-in test and the final test. In other words, it is possible to avoid an event such that the burn-in voltage is applied to the internal circuits in the normal operation mode. In this regards the semiconductor devices are very effective in practical use.

The present invention is not limited to the specifically disclosed embodiments, and variations and modifications may be made without departing from the scope of the present invention.

What is claimed is:

1. A semiconductor integrated circuit device comprising:

a flat-range voltage supply unit which steps down an external power supply voltage and generates a resultant, flat-range voltage;

a burn-in voltage supply unit which generates a burn-in voltage depending on the external power supply voltage;

a switching unit which selects either the flat-range voltage or the burn-in voltage, a selected voltage being supplied to an internal circuit; and a switching instruction unit which includes program means and generates a switching instruction signal in response to a value programmed in the program means, said value programmed being independent of a failure of any supply voltage externally applied to the semiconductor integrated circuit device; and a switching control unit which controls the switching unit in accordance with the switching instruction signal.

2. The semiconductor integrated circuit device as claimed in claim 1, wherein said burn-in voltage is equal to the external power supply voltage.

3. The semiconductor integrated circuit device as claimed in claim 1, wherein said burn-in voltage is lower than the external power supply voltage.

4. The semiconductor integrated circuit device as claimed in claim 1, the burn-in voltage supply unit performs a level shift operation on the external power supply voltage so that the level shift operation results in said burn-in voltage lower than the external power supply voltage.

5. The semiconductor integrated circuit device as claimed in claim 4, wherein the burn-in voltage supply unit shifts the external supply voltage in a predetermined ratio with respect to the external power supply voltage.

6. The semiconductor integrated circuit device as claimed in claim 1, wherein the switches of said switching instruction unit comprise fuses.

7. The semiconductor integrated circuit device as claimed in claim 6, wherein the switches of said switching instruction unit comprise erasable programmable read only memories.

8. The semiconductor integrated circuit device as claimed in claim 1, wherein said switching control unit comprises an exclusive-OR circuit.

9. The semiconductor integrated circuit device as claimed in claim 1, wherein said switching unit comprises an analog switch of a CMOS structure.

10. The semiconductor integrated circuit device as claimed in claim 1, wherein said internal circuit comprises a memory.

11. The semiconductor integrated circuit device as claimed in claim 1, wherein:

the switching instruction unit includes first and second switches and generates a first switching instruction signal by turning ON or OFF both the first and second switches, and generates a second switching instruction signal by turning OFF the second switch;

the switching control unit being responsive to the first switching instruction signal to control the switching unit to select the flat-range voltage and being responsive to the second switching instruction signal to control the switching unit to select the burn-in voltage.

12. A method of testing a semiconductor integrated circuit device comprising:

stepping down an external power supply voltage and generating a resultant, flat-range voltage;

generating a burn-in voltage depending on the external power supply voltage; and selecting either the flat-range voltage or the burn-in voltage, and supplying the selected voltage to an internal circuit including the sub-steps of:

(a) turning ON first and second switches to select the flat-range voltage;

(b) turning OFF the first switch to select the burn-in voltage; and (c) turning OFF the second switch to select the flat range voltage.

13. The method as claimed in claim 12, wherein the step (b) comprises a step of cutting a fuse forming the first switch on a wafer from on which the semiconductor integrated circuit device is finally produced.

14. The method as claimed in claim 12, wherein the step (c) comprises a step of electrically cutting a fuse forming the second switch when the semiconductor integrated circuit device is packaged.

15. The method as claimed in claim 12, wherein the step (b) comprises a step of writing data into an erasable programmable read only memory forming the first switch.

16. The method as claimed in claim 12, wherein the step (c) comprises a step of writing data into an erasable programmable read only memory forming the second switch.

17. A semiconductor integrated circuit device comprising:

a flat-range voltage supply unit which steps down an external power supply voltage and generates a flat-range voltage;

a burn-in voltage supply unit which generates a burn-in voltage higher than the flat-range voltage;

a switch circuit selecting either the flat-range voltage or the burn-in voltage in response to an instruction signal to provide a selected voltage to an internal circuit; and program means providing said instruction signal indicating a programmed value which is independent of a failure of any supply voltage externally applied to the semiconductor integrated circuit device.

18. The semiconductor integrated circuit device as claimed in claim 17, wherein said programmable circuit comprises a fuse.

19. The semiconductor integrated circuit device as claimed in claim 17, wherein said programmable circuit comprises a rewritable read only memory.

20. A semiconductor integrated circuit device comprising:

a flat-range voltage supply unit which steps down an external power supply voltage and generates a resultant, flat-range voltage;

a burn-in voltage supply unit which generates a burn-in voltage depending on the external power supply voltage;

a switching unit which selects either the flat-range voltage or the burn-in voltage, a selected voltage being supplied to an internal circuit; and a switching instruction unit which includes program means and generates a switching instruction signal in response to a value programmed in the program means, said value programmed being independent of a failure of any supply voltage externally applied to the semiconductor integrated circuit device; and a switching control unit which controls the switching unit in accordance with the switching instruction signal;

wherein the program means is one of fuses and a ROM.

21. A semiconductor integrated circuit device comprising:

a flat-range voltage supply unit which steps down an external power supply voltage and generates a resultant, flat-range voltage;

a burn-in voltage supply unit which generates a burn-in voltage depending on the external power supply voltage;

a switching unit which selects either the flat-range voltage or the burn-in voltage, a selected voltage being supplied to an internal circuit; and a switching instruction unit which includes program means and generates a switching instruction signal in response to a value programmed in the program means; and a switching control unit which controls the switching unit in accordance with the switching instruction signal, wherein said program means functions to change said value programmed from a first value to a second value and from said second value to a third value, said switching unit selecting the flat-range voltage when either of said first and third values is programmed in said program means, and said switching unit selecting the burn-in voltage when said second value is programmed in said program means, wherein said program means functions to program said second value only once.

22. The semiconductor integrated circuit device of claim 21, wherein said value programmed in the program means is independent of a variation in a supply voltage externally applied to the semiconductor integrated circuit device.

23. The semiconductor integrated circuit device of claim 1, wherein said value programmed in the program means is independent of a variation in any voltage externally applied to the semiconductor integrated circuit device.

24. The semiconductor integrated circuit device of claim 1, wherein the burn-in voltage is supplied to said internal circuit only for one time period.

25. The semiconductor integrated circuit device of claim 1, wherein said burn-in voltage is supplied to the internal circuit such that defective transistors are degraded by the supply of the burn-in voltage to thereby allow determination of whether the semiconductor integrated circuit device is defective.

26. The semiconductor integrated circuit device of claim 1, wherein the flat-range voltage is a substantially constant voltage.

27. The semiconductor integrated circuit device of claim 1, wherein the flat-range voltage supply unit and the internal circuit are provided on one semiconductor chip.

28. The semiconductor integrated circuit device of claim 1, wherein the burn-in voltage is greater than the normal operation voltage range for the internal circuit of said semiconductor integrated circuit device.

29. The semiconductor integrated circuit device of claim 17, wherein the burn-in voltage is supplied to said internal circuit only for one time period.

30. The semiconductor integrated circuit device of claim 17, wherein said burn-in voltage is supplied to the internal circuit such that defective transistors are degraded by the supply of the burn-in voltage to thereby allow determination of whether the semiconductor integrated circuit device is defective.

31. The semiconductor integrated circuit device of claim 17, wherein the flat-range voltage is a substantially constant voltage.

32. The semiconductor integrated circuit device of claim 17, wherein the flat-range voltage supply unit and the internal circuit are provided on one semiconductor chip.

33. The semiconductor integrated circuit device of claim 17, wherein the burn-in voltage is greater than the normal operation voltage range for the internal circuit of said semiconductor integrated circuit device.

34. The semiconductor integrated circuit device of claim 20, wherein the burn-in voltage is supplied to said internal circuit only for one time period.

35. The semiconductor integrated circuit device of claim 20, wherein said burn-in voltage is supplied to the internal circuit such that defective transistors are degraded by the supply of the burn-in voltage to thereby allow determination of whether the semiconductor integrated circuit device is defective.

36. The semiconductor integrated circuit device of claim 20, wherein the flat-range voltage is a substantially constant voltage.

37. The semiconductor integrated circuit device of claim 20, wherein the flat-range voltage supply unit and the internal circuit are provided on one semiconductor chip.

38. The semiconductor integrated circuit device of claim 20, wherein the burn-in voltage is greater than the normal operation voltage range for the internal circuit of said semiconductor integrated circuit device.

39. A semiconductor integrated circuit device comprising:

a flat-range voltage supply unit which steps down an external power supply voltage and generates a resultant, flat-range voltage;

a burn-in voltage supply unit which generates a burn-in voltage depending on the external power supply voltage;

a switching unit which selects either the flat-range voltage or the burn-in voltage, a selected voltage being supplied to an internal circuit; and a switching instruction unit which includes program means and generates a switching instruction signal in response to a value programmed in the program means, said value programmed being independent of a programmed variation in, an intentional variation in, and a failure of any supply voltage externally applied to the semiconductor integrated circuit device; and a switching control unit which controls the switching unit in accordance with the switching instruction signal.

* * * * *